US005857586A

United States Patent [19]

Scherr

[11] Patent Number: 5,857,586

[45] Date of Patent: Jan. 12, 1999

[54] DISPENSER FOR PLASTIC BAGS

[75] Inventor: Donald Scherr, West End, N.J.

[73] Assignee: U.S. Plastics, Ltd., Long Branch, N.J.

[21] Appl. No.: 898,027

[22] Filed: Jul. 22, 1997

Related U.S. Application Data

[63] Continuation-in-part of Ser. No. 805,880, Mar. 3, 1997, which is a continuation-in-part of Ser. No. 540,163, Oct. 6, 1995, Pat. No. 5,657,900.

[51] Int. Cl.[6] ..... A47K 10/24

[52] U.S. Cl. ..... 221/45; 221/283; 206/554

[58] Field of Search ..... 221/33, 45, 63, 221/282, 283; 206/494, 554, 225; 383/37

[56] References Cited

U.S. PATENT DOCUMENTS

| | | | |
|---|---|---|---|
| 3,307,740 | 3/1967 | Fant | 221/282 |
| 4,216,863 | 8/1980 | Seymour-Smith | 206/554 |
| 4,858,784 | 8/1989 | Moody | 221/283 |

*Primary Examiner*—Kenneth Noland

*Attorney, Agent, or Firm*—Marvin Feldman

[57] ABSTRACT

A dispenser is formed of a flexible plastic pouch which has a removable flap providing an opening adjacent the bottom of the pouch, and a mounting element adhesively attached adjacent the top of the pouch which provides selective mounting to diverse surfaces. The mounting element has opposed interengaged Velcro pads whereby when the pouch is adhesively mounted to a surface, the Velcro pads may be disengaged and the pouch removed and replaced with another pouch. A plurality of stacked reclosable ended separate plastic bags are disposed in a folded stack within the pouch. A portion of one outermost plastic bag is disposed in the bottom pouch opening so that the user by the thumb and forefinger pulls the one plastic bag portion causing the one plastic bag to frictionally engage and slide over the adjacent plastic bag and through the opening without tearing the pouch or dismounting the mounting element from the surface mount. After removal of one bag, the next immediately adjacent bag is then similarly positioned for removal. The removed plastic bag is immediately ready for filling. With removal of all the bags, the depleted pouch is detached and replaced with a full pouch by the Velcro pads engagement.

10 Claims, 2 Drawing Sheets

1/2
2
4
10
11
12
13
14
15
16
20
21
22
23
24
25
26
27
28
29
30
31
32
33
35
36
37
38
39
40
41
45
48

FIG. 5
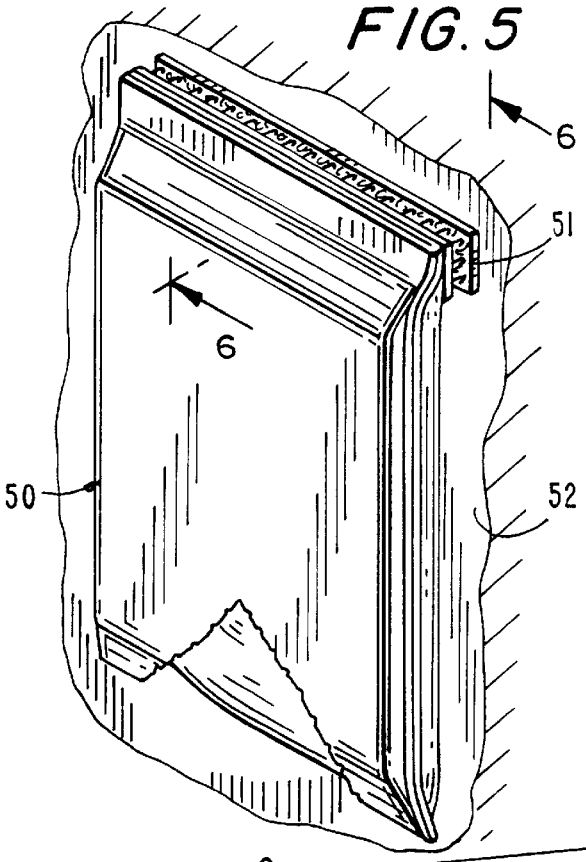
FIG. 6
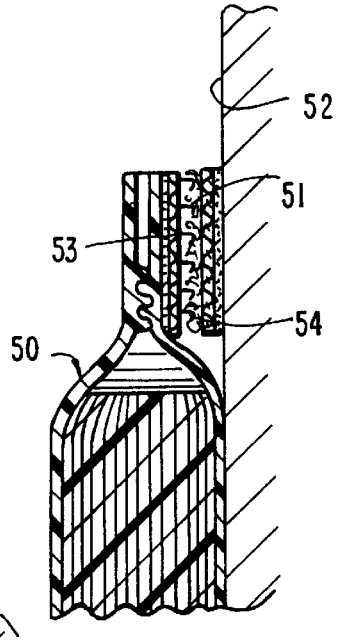
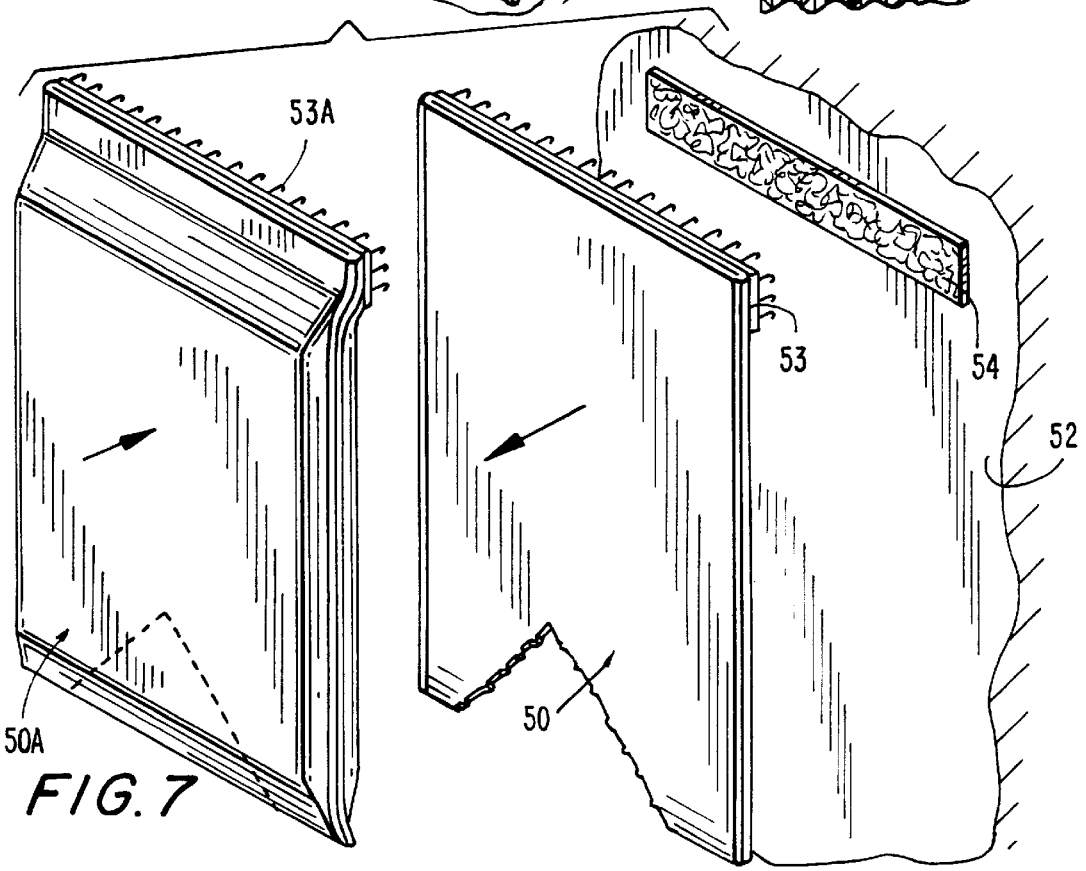
FIG. 7

DISPENSER FOR PLASTIC BAGS

RELATED PENDING APPLICATIONS

This application is a continuation-in-part of application Ser. No. 08/805,880, filed Mar. 3, 1997, which is a continuation-in-part of Ser. No. 08/540,163, filed Oct. 6, 1995 now U.S. Pat. No. 5,657,900.

BACKGROUND OF THE INVENTION

1. Field of the Invention

This invention relates to improvements in a dispenser for plastic bags or like articles.

2. Discussion of the Prior Art

In the art directed to dispensers for plastic bags, such constructions were generally constructed of rigid box-like containers wherein the plastic bags were separably interconnected within the box. Such dispensers are disclosed in U.S. Pat. No. 4,712,684 to Boeckman, U.S. Pat. No. 4,805,800 to Nocek et al and U.S. Pat. No. 5,109,978 to Cawley. One attempt to make the plastic bags more readily removable from a box is disclosed in U.S. Pat. No. 4,512,276 to Herrington. In Herrington the plastic bags had to first be individually folded on parallel fold lines formed in each bag, and then assembled and stacked within the box. In another rigid walled construction bag dispenser, such as is disclosed in U.S. Pat. No. 5,267,423 to Nguyen, separate stacked bags were mounted on a roller bar for bag removal.

Another prior art approach was where there was no container or dispenser, and instead the plastic bags were detachably attached on a header with the user having to pull and separate the bag from the header usually at a perforated line, and open the bag during or after removal. Such prior art constructions are disclosed in U.S. Pat. No. 3,221,927 to Lowry, U.S. Pat. No. 4,290,467 to Schmidt, U.S. Pat. No. 4,846,586 to Bruno, U.S. Pat. No. 5,255,883 to Greenfield et al, U.S. Pat. No. 5,309,698 to Huseman and U.S. Pat. No. 5,419,437 to Huseman.

One attempt to provide mounting a plastic bag dispenser is disclosed in U.S. Pat. No. 4,216,863 to Seymour-Smith. The Seymour-Smith mounting construction required that the dispenser top portion be strengthened and provided with a through hole by which the dispenser was suspended vertically from a hook. The use of a punched hole in the top of the dispenser as the mounting element was undesirable in that excessive thermo-forming or dispenser strengthening was required to prevent tearing of the bag around the hole, and particularly so when the plastic bags slidingly frictionally engaged the pouch and other bag surfaces in removal. Still further, the location of the dispenser was limited by the presence and location of the hook and hook mount on the wall. Further it was both necessary and most inconvenient to obtain a hook suitably sized and mounted in order to use the Seymour-Smith bag dispenser. Users would also be incumbered in mounting the hook and then be constrained in the dispenser mount location by the hook mount location.

Now there is provided by the present invention an improved plastic bag dispenser which is selectively mounted to diverse vertical and horizontal surfaces, and wherein the dispenser when depleted of plastic bags can be detached from the selected surface mount and then readily replaced with a full dispenser on the same mounting element.

The art also desired a readily manufactured and assembled low cost flexible construction bag dispenser which could store and readily dispense a folded stack of bags without damage to the thin walled flexible plastic sheet construction dispenser. The present invention achieves these prior art goals as well.

SUMMARY OF THE INVENTION

In one aspect, the invention is a pouch containing separate articles, such as plastic bags, in sliding frictional engagement, wherein the pouch has means for providing a selective opening for removal of the bags, and a mounting feature or element for mounting the dispenser to diverse surfaces, which mounting feature is detachably attached to the pouch so that the pouch when emptied of plastic bags is readily detached and replaced by a full pouch. The detachable feature, in one preferred aspect, are opposed interengaged Velcro pad elements.

In another aspect, the top of the pouch is adhesively bonded to one Velcro pad. A second Velcro pad is bonded to a releasable adhesive tape. The Velcro pads are interengaged with the tape mounted from the pouch to a selected surface. After all the plastic bags are removed from the pouch, the Velcro elements are disengaged, and the removed pouch is replaced by a full pouch.

The dispenser may be formed of flexible plastic panels or sheets joined or thermoplastically bonded at the edges to form a flexible plastic pouch having a removable flap in one of the panels adjacent the bottom of the pouch to provide an opening for removal of the plastic bags. A plurality of separate reclosable plastic bags are in stacked disposition for sliding frictional engagement within the pouch. The plastic bags have reclosable ends which may be open within the pouch. The plastic bags are in a folded stacked arrangement, and the pouch flexes outwardly to accommodate the stacked plastic bags. The removable flap is preferably triangularly shaped and formed by perforations in one or both of the panels. When the flap is removed at the perforations, a triangularly shaped opening is provided, for access to a portion of the outermost bag.

To remove a bag, a user, using the thumb and then the forefinger of one hand, pulls the outermost plastic bag disposed in the opening downwardly so that the outermost plastic bag frictionally engages and slides over the adjacent plastic bag of the folded stacked bags, which outermost bag folds inwardly on itself in contactingly engaging the pouch edges forming the triangular opening. After removal of the outermost bag, the immediately adjacent bag is then disposed in the opening. The removed opened bag is immediately ready for filling and closure. The dispenser remains firmly mounted to the wall or other mount surface during removal of each plastic bag.

BRIEF DESCRIPTION OF THE DRAWING

FIG. 5 is a perspective view of the preferred embodiment of the present invention mounted to a second surface;

FIG. 6 is an enlarged fragmentary sectional view taken along line 6—6 of FIG. 3; and FIG. 7 is a perspective exploded view of the dispenser as shown in FIG. 6, specifically showing removal of a depleted dispenser pouch and replacement with a full pouch.

DESCRIPTION OF THE PREFERRED EMODIMENTS

Figures 1, 2, 3, 4:
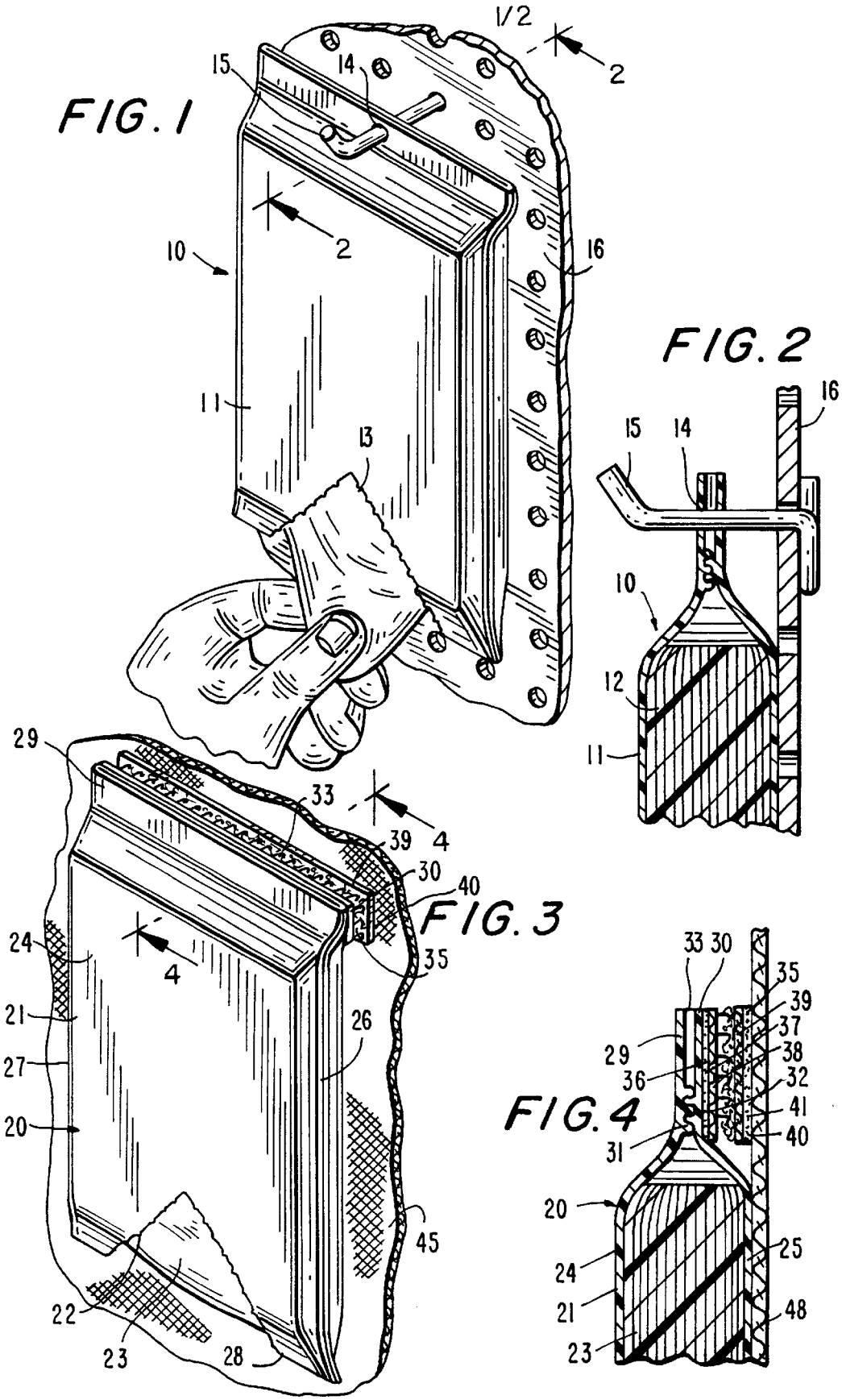
FIG. 1 is a perspective view of a dispenser as described in my co-pending applications, Ser. Nos. 08/540,163 and 08/805,880.
FIG. 2 is an enlarged fragmentary sectional view taken along line 2—2 of FIG. 1.
FIG. 3 is a perspective view of the preferred embodiment of the present invention mounted to a first surface.
FIG. 4 is an enlarged fragmentary sectional view taken along line 4—4 of FIG. 3.

Referring to FIGS. 1 and 2 there is shown an embodiment of my prior invention, namely dispenser 10. Dispenser 10 is comprised of a flexible plastic pouch 11 containing a plurality of plastic bags 12 with an opening 13 for bag removal, as shown and described in U.S. patent applications Ser. No. 08/805,880 filed Mar. 3, 1997 and Ser. No. 08/540,163, filed Oct. 6, 1995, which are hereby incorporated herein by reference thereto.

Dispenser 10 is formed with through hole 14. A metal hook 15 is mounted on peg board 16. Pouch 11 is mounted by hole 14 on hook 15. This manner of construction required that the user be provided with hook 15, and the mounting surfaces were limited in that they had to provide for receiving the mounting hook often with a permanent hook mount, effectively limiting the mount and hook location and in turn the dispenser location. A peg board 16 type mount provided multiple hook mount locations, but was also undesirable to provide as well as for aesthetic considerations.

Referring now to FIGS. 2–7, there is shown the embodiment of my present invention with the improved mounting features.

Referring specifically to FIGS. 3 and 4 there is shown dispenser 20 comprised of pouch 21 formed of flexible plastic panel or sheets and having a bottom opening 22 for bag by bag removal of the stacked foled plastic bags 23 disposed within pouch 21. Specifically, Pouch 21 is formed of opposed plastic sheets 24 and 25 which are thermoplastically sealed at the sides 26 and 27 and bottom 28 to form pouch 21. The respective top portions 29 and 30 of sheets 24 and 25 are formed with opposed interlocking elongated plastic elements 31 and 32, well known in art, for zippered lock closing of the top 33 of pouch 21. The pouch may be filled with the folded stacked bags through the opening in top 33 made by disengagement or unlocking of zippered elements 31 and 32. If desired, elements 31 and 32 may be thermoplastically sealed after filling the pouch with the plastic bags.

A mounting member 35 is adhesively secured to top panel portion 30 by adhesive 36. Member 35 comprises elongated coextensive elements: pad 37, Velcro hook element pad 38 adhesively secured Velcro tuft or eye element pad 39 which disengageably engages Velcro pad 39, with pad 39 fixedly bonded to tape 40. Tape 40 is formed with releasable adhesive 41. A protective cover (not shown) is releaseably bonded by 41 to tape 40, which protective cover is removed prior to adhesive mounting the dispenser. That is, with the protective cover removed, mounting member 35 is adhesively bonded by adhesive 41 to a wall or wallboard 45.

In the aforesaid manner of construction, the embodiment of FIGS. 3 and 4 is used by first removing the protective cover tape (not shown) and adhering the dispenser 20 to wallboard 45 by adhesive 41. The bottom opening 22 in the pouch is provided in the manner set forth in my afore-described co-pending applications. The user then removes the plastic bags one at a time from the pouch until the pouch is emptied. The user then disengages Velcro pads 38 and 39 to remove the depleted pouch from the wallboard mount. A new full pouch (not shown in FIGS. 3 and 4) is then attached by its own Velcro pad 38 to Velcro pad 39 mounted to the wallboard 45. The bag removal process is then repeated with the newly mounted replacement pouch.

Referring now to FIGS. 5–7, there is shown another embodiment of the invention namely pouch 50 attached to and mounted by mounting member 51 to flat smooth wall surface 52. Pouch 50 and mounting member 51 are similar in construction to that in the afore-described dispenser 20 and mounting member 35. Pouch 50 in this latter embodiment is mounted to a flat smooth wall, such as a painted wall 52 in contradistinction to wallboard 45 of FIGS. 3 and 4.

Referring now specifically to FIG. 7, there is shown the removal of depleted pouch 50 by disengagement of Velcro pads 53 and 54, with pad element 54 remaining adhesively mounted to wall 52. Depleted pouch 50 is then replaced with full pouch 50A with its Velcro pad element 53A interengaged with Velcro pad element 54.

It was surprisingly found that with the pouch adhesively mounted to a wall, the plastic bags could be repeatedly removed with sliding frictional engagement of the ot her plastic bags and the inside of the pouch without dismounting the pouch from the wall.

It is important to note that the pouch may also be repositioned on another wall or wall location by releasing the pouch from its at adhesive wall mount, and re-adhering the pouch to another wall surface. It is thus within the contemplation of the invention that with smooth walled surfaces in contradistinction to more adhering surfaces, the user could adhesively remove the mounting wall and relocate it on the same or another wall. Where the mounting member is adhered to a particularly adherent wall surface, the user could then use a new or fresh mounting member and adhere it to another more desired location. In these manner of applications, the user can readily locate or relocate a mounting member as desired. The invention contemplates mounting on both vertical and horizontal surfaces.

While the invention has been described in conjunction with preferred specific embodiments, it will be understood that this description is merely to illustrate and not limit the scope of the invention, as set out in the following claims.

What is claimed is:

1. A dispenser for plastic bags comprising, front panel means and back panel means, and means for joining the front and back panel means to form pouch means, one said panel means being formed with opening means, and a plurality of plastic bags disposed within said pouch means with a portion of one plastic bag disposed at said opening means for removal of the plastic bags, and further compromising means for mounting said pouch means to a surface, and means for attaching said means for mounting to one of said panel means, said front and back panel means being formed with means for selectively separating said panel means for filling the pouch means with plastic bags, whereby with the dispenser mounted to a surface, the user pulls the one plastic bag portion through the opening means to remove the one plastic bag from the pouch means.

2. The dispenser of claim 1, said means for mounting being disposed adjacent said means for selectively separating said front and back panel means.

3. A dispenser for flat plastic articles comprising, front panel means and back panel means, and means for joining the front and back panel means to form pouch means, one said panel means being formed with opening means, and a plurality of flat plastic articles disposed within said pouch means with a portion of one plastic article disposed at said opening means for removal of the plastic articles, and further compromising Velcro means for mounting said pouch means to a surface, and means for attaching said means for mounting to one of said panel means, said Velcro means for mounting comprising first pad means and second pad means, and means for disengageably engaging said first and second pad means, and said first pad means comprising said means for attaching to one of said panel means, whereby with the dispenser mounted to a surface, the user pulls the one plastic article portion through the opening means to remove the one plastic article from the pouch means, and when the pouch means is mounted and emptied of plastic articles, the Velcro pad means are disengaged and the empty pouch means is detached and replaced with a full pouch means.

4. The dispenser of claim 3, said means for mounting and said opening means being disposed adjacent opposite ends of said pouch means.

5. The dispenser of claim 4, said opening means comprising flap means formed by perforations in said front panel means, whereby with separation of the flap means by the perforations said opening menas is formed in said front panel means for removal of the plastic bags.

6. The dispenser of claim 5, said means for mounting being disposed on said back panel means.

7. The dispenser of claim 6, further comprising means for bonding one said Velcro pad means to the back panel means.

8. The dispenser of claim 7, further comprising cover tape means for protecting the adhesive means prior to mounting the pouch means.

9. A dispenser for a plurality of articles comprising:

pouch means for holding a plurality of articles in frictional sliding relationship, said pouch means being formed with opening means for slidably removing the articles one at a time, and said pouch means comprising Velcro means for mounting said pouch means to a surface, said Velcro means comprising cover tape means adhesively bonded to said Velcro means, whereby with the dispenser mounted to a surface the use pulls one of said articles is sliding engagement away from one of the other articles and through the opening means to remove the article from the pouch means, and with removal of the cover tape means the dispenser is mounted to a surface, and with disconnect of said Velcro means the emptied pouch means is detached for replacement with a full pouch means.

10. The dispenser of claim 10, said pouch means and said articles comprise flexible thermoplastic sheet construction.

* * * * *